United States Patent [19]

Haak et al.

[11] 4,206,688

[45] Jun. 10, 1980

[54] OVERRUNNING LOAD CONTROL FOR HYDRAULIC MOTORS

[75] Inventors: Willard J. Haak, Peoria; Howard A. Marsden, Pekin; Paul C. Moots, East Peoria, all of Ill.

[73] Assignee: Caterpillar Tractor Co., Peoria, Ill.

[21] Appl. No.: 914,117

[22] Filed: Jun. 9, 1978

[51] Int. Cl.[2] ..... F15B 11/08; F15B 13/042

[52] U.S. Cl. ..... 91/452; 91/454; 91/461; 137/596.2

[58] Field of Search ..... 91/445, 452, 446, 461, 91/454; 137/596.2

[56] References Cited

U.S. PATENT DOCUMENTS

| | | | |
|---|---|---|---|
| 2,157,707 | 5/1939 | Keel | 91/446 |
| 3,972,267 | 8/1976 | Haak et al. | 91/445 |
| 4,114,516 | 9/1978 | Johnson | 91/420 |
| 4,153,074 | 5/1979 | Risk | 91/446 X |

*Primary Examiner*—Irwin C. Cohen

*Attorney, Agent, or Firm*—Wegner, Stellman, McCord, Wiles & Wood

[57] ABSTRACT

A hydraulic system including a hydraulic motor having a port adapted to be connected to a reservoir and a hydraulic fluid pump. A normally closed check valve connects the port to the reservoir and includes two, hydraulically opposed, differential surfaces, one being smaller than the other and being disposed to be responsive to pressure at the port. Included is a normally closed, pilot-operated, first metering valve having an inlet and an outlet and a second metering valve also having an inlet and an outlet along with a shiftable metering element interposed therebetween. A spring biases the element towards a position minimizing flow between the inlet and the outlet and a pressure responsive surface is disposed on the element in bucking relation to the spring. The first valve inlet is connected to the second valve outlet and to a larger surface of the check valve and the port is connected to the second valve inlet as well as connected to direct pressure to the second valve pressure responsive surface. The first valve outlet is connected to the reservoir. The first valve controls the degree to which the check valve may open while the second valve provides load compensation in the circuit.

10 Claims, 2 Drawing Figures

TO ADDITIONAL CIRCUITS

OVERRUNNING LOAD CONTROL FOR HYDRAULIC MOTORS

BACKGROUND OF THE INVENTION

This invention relates to hydraulic circuits including a hydraulic motor and provided with an overrunning load control.

Many directional control circuits for high pressure hydraulic systems utilize check valves of the poppet type for controlling the flow of fluid to and from a hydraulic motor. Poppet type check valves provide positive blockage of fluid flow when closed to a greater degree than, for example, conventional spool valves.

In general, the speed of the hydraulic motor is controlled by modulating the fluid flow from a pump to the motor. However, a difficulty is frequently encountered in terms of providing fine control of a so-called "overrunning load" condition as, for example a heavy load supported by hydraulic cylinders being lowered. In such a case, the flow path through the poppet valve must be finely controlled in order to ensure positive, fine and reproducible control of the hydralic motor.

While many systems heretofore designed for the purpose of providing fine control of a hydraulic motor when an overrunning load condition exists have performed generally satisfactorily, system instability may occur because of a valve's response to its internal fluid flow forces or as a result of interactions with other system components. Moreover, in some cases, control characteristics may vary, dependent upon the load itself.

SUMMARY OF THE INVENTION

The present invention is directed to overcoming one or more of the above problems.

According to the invention, there is provided a hydraulic system including a hydraulic motor having a port and conduit means adapted to be connected to a hydraulic fluid reservoir. A main flow valve, adapted to be closed, has an inlet connected to the port and an outlet connected to the conduit means. Actuator means are provided for opening and closing the main flow valve and there are further provided control means for the actuator means including a pressure responsive, variable orifice means including a fluid flow path of variable size dependent upon pressure which is connected to the port and to the actuator means. A variable flow metering valve interconnects the junction of the orifice means flow path and the actuator means and the conduit means.

Preferably, though not necessarily, the hydraulic circuit further includes feedback means for stabilizing the metering valve.

Other objects and advantages will become apparent from the following specification taken in connection with the accompanying drawings.

DESCRIPTION OF THE PREFERRED EMBODIMENTS

Figures 1, 2:
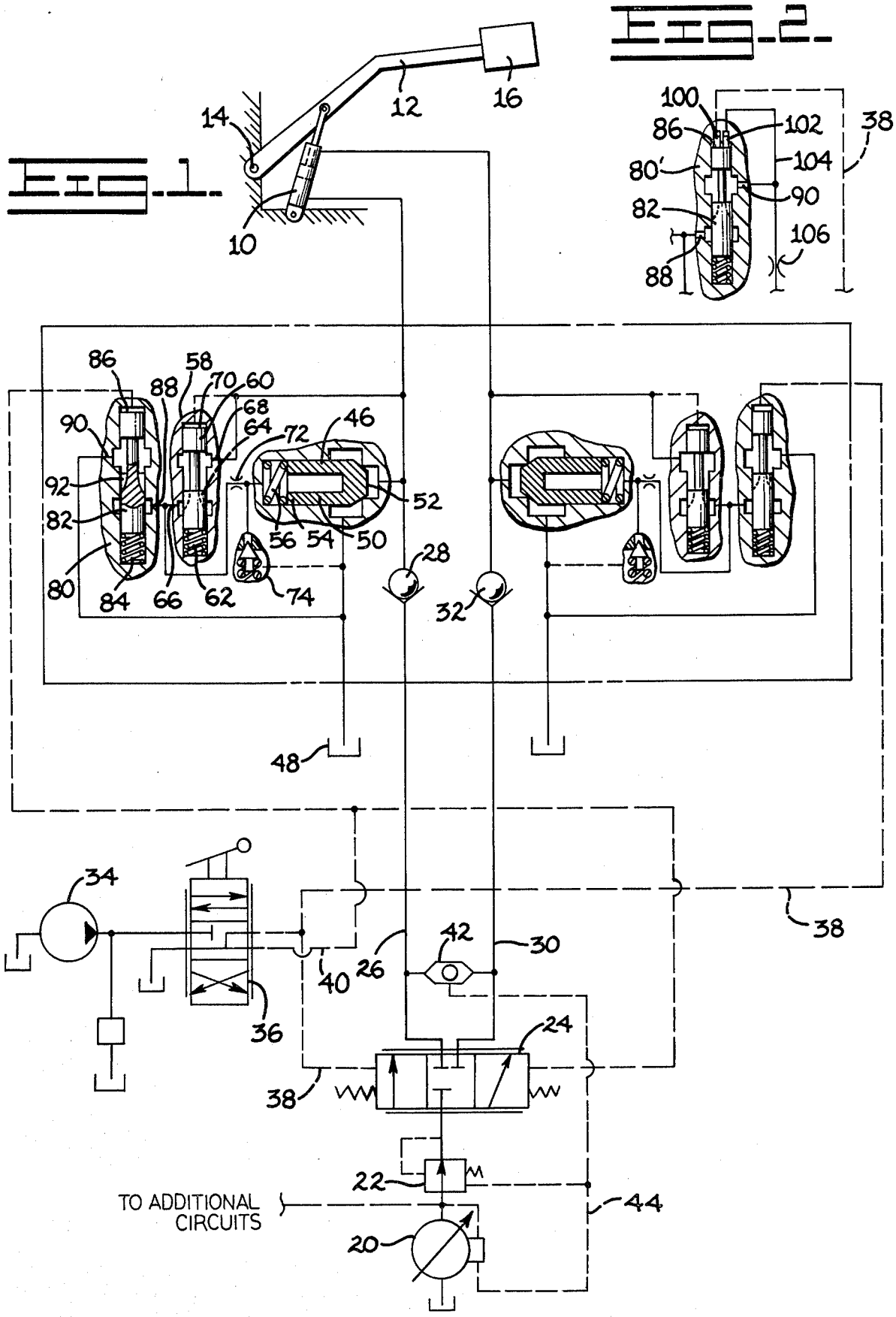
FIG. 1 is a hydraulic schematic illustrating a hydraulic circuit made according to the invention.
FIG. 2 is a fragmentary, hydraulic schematic illustrating a modified and highly preferred embodiment of part of the system.

An exemplary embodiment of the invention is illustrated in FIG. 1 and is seen to include a hydraulic motor 10, in the form of a double-acting, hydraulic cylinder. However, it is to be understood that the invention is not limited to use with reciprocating hydraulic motors but can be utilized with rotary ones as well.

The cylinder 10 is connected to an arm 12 intermediate its ends and one end is pivoted at 14 by suitable means while the other end bears a load 16. The cylinder 10 may be operated to lift or lower the load 16. However, a circuit of the invention is not limited to use in situations where loads are to be lifted or lowered. It may also be employed with efficacy where overrunning load conditions come into existence as a result of, for example, inertia forces, such as those typically present in vehicles having rotary mounted cabs and in the swing circuits thereof.

A hydraulic pump 20, preferably of the flow and pressure compensated type, is provided and is operative to direct hydraulic fluid under pressure through a flow control valve 22 to a main control valve 24. The main control valve is of the double-piloted, spring-centered type. When centered, no fluid will pass through the valve 24 while when actuated in one direction, fluid will be directed via a line 26 through a check valve 28 to the head end of the cylinder 10. When actuated in the other direction, fluid will be directed through a line 30 via a check valve 32 to the rod end of the cylinder 10. The amount of fluid passing through the valve 24 when actuated in either direction will, of course, be dependent upon the degree to which it is actuated by pilot pressure.

A hydraulic pump 34 is also provided as a source of pilot fluid under pressure and its output is directed to a manually operated control valve 36 having a pair of outputs. One output is designated 38 and is directed to the left-hand pilot of the valve 24 while the other is designated 40 and is directed to the right-hand pilot of the valve 24. When pilot fluid under pressure is present in the line 38, the valve 24 will shift to direct fluid under pressure to the head end of the cylinder 10. Pressure will be directed to the rod end of the cylinder 10 by the valve 24 when pilot fluid under pressure is present in the line 40.

As noted, the pump 20 is flow and pressure compensated and to provide an appropriate signal thereto, a resolver 42 is connected between the lines 26 and 30 and has an output line 44 extending to the pump 20. The resolver 42 acts in a conventional fashion to signal the pump 20 to cause the same to respond to load variation.

Each side of the cylinder 10 is provided with an overrunning load control made according to the invention. The two overrunning load controls are identical and in the interests of brevity, only one will be described.

A flow control poppet valve 46 is connected to the head end port of the cylinder 10 and to a hydraulic reservoir 48. The poppet valve 46 includes a poppet 50 having opposed, pressure responsive surfaces 52 and 54. In addition, a spring 56 acts against the surface 54.

As can be seen, the surface 52 presented to pressure from the cylinder 10 is smaller than the surface 54. Because of this relationship, and because of the presence of the spring 56, the poppet 50 will open only when the pressure applied to the surface 52 considerably exceeds that applied to the surface 54.

The system further includes a load compensating spool valve 58 of the metering type. The valve 58 includes a spool 60 which is normally biased towards, but not to, a closed position by a spring 62. Metering slots 64 are so configured with respect to an outlet port 66 such that at no time will a flow path to the outlet 66 from an inlet 68 be completely closed.

The spool 60 includes a pressure responsive surface 70 in bucking relation to the spring 62. As pressure applied to the surface 70 increases, the spool 60 will shift, increasing the orifice provided by the metering slots 64.

The outlet 66 of the valve 58 is connected via an orifice 72 to the poppet valve 46 to direct fluid against the surface 54 thereof. The inlet 68 of the valve 58 is connected to the head end port of the cylinder 10 and, because the spool 60 never completely closes the flow path to the valve 58, all other things being equal, equal pressure will be applied to both the surface 52 and the surface 54 of the poppet valve 46 to maintain the same in a closed condition.

A conventional relief valve 74, for the usual purpose, is hydraulically interposed between the orifice 72 and the surface 54 and is operative to direct fluid to the reservoir 48 whenever pressure applied to the surface 54 is in excess of some predetermined amount.

The system is completed by an operator controlled valve 80. The valve 80 is a pilot operated spool valve having a spool 82 biased by a spring 84 to a closed position. Bucking the spring 84 is a pressure responsive surface 86 which is connected to the pilot line 40 in the case of the valve 80 shown in the left-hand side of FIG. 1, and to the pilot output 38 in the case of the valve 80 shown on the right-hand side of FIG. 1.

The valve 80 has an inlet 88 connected to the outlet 66 of the valve 58 and an outlet 90 connected to the reservoir 48. The spool 82 is provided with metering slots 92 with the consequence that when the spool 82 is shifted towards an open position, the size of the orifice will vary, dependent upon the amount of pressure directed to the pilot surface 85 from the control valve 36.

Operation is as follows. Assuming the load 16 is to be lowered, the pilot valve 36 is manually shifted by the operator to some point commanding a given rate of descent. This will result in pilot pressure being applied to the right-hand side of the main valve 24 to direct fluid to the rod end of the cylinder. It will also cause pilot pressure to be directed against the pilot surface 86 of the valve 80, the greater the rate of descend desired, the greater the pressure applied.

In any event, the spool 82 will move towards an open position some desired amount, depending upon the rate of descent called for. As a consequence, fluid trapped against the surface 54 of the poppet 46 will be permitted to flow to drain 48 through the now open valve 80. Consequently, relief of fluid under pressure against the surface 54 will result in the pressure applied to the surface 52 causing the poppet 50 to open to allow exhausting of the head end of the cylinder 10. Control of the descent rate is obtained by the fact that whenever fluid flow through the valve 58 begins to exceed that passing through the valve 80, pressure against the surface 54 will increase due to the lesser pressure drop tending to close the poppet 50 and limit the descent rate.

A steady state condition will exist when the flow through the valve 58 equals the flow through the valve 80.

Should the load 16 begin to overrun, pressure in the head end of the cylinder 10 will begin to increase. As a consequence, a greater force is applied against the pressure responsive surface 70 of the valve 58 to cause the spool 60 to shift towards a more open position. As a consequence, fluid flow through the valve 58 will begin to exceed fluid flow through the valve 80 with the consequence that the poppet 50 will be shifted towards a closed position to retard the rate of descent and provide the selected rate.

It will be recognized that the valve 58 provides so-called "load compensation". That is, the valve 58 ensures that the same rate of descent will occur for a given setting of the control valve 36 regardless of the actual weight of the load 16. For example, the heavier the load 16, the greater the pressure applied to the surface 52 tending to open the valve 46. However, this same pressure is applied against the pressure responsive surface 70 of the valve 58 to cause the latter to open to a greater degree to increase the flow rate across the same, thereby decreasing the pressure drop across the valve 58. As a consequence, a higher pressure will be applied to the surface 54 of the valve 46 tending to close the same to offset the increased pressure tending to open it.

In a lift system having the specific configuration illustrated by the components 10, 12, 14 and 16, an overrunning load condition can exist substantially only when the load is being lowered. In such a case, the components 50–92, inclusive, on the right-hand side of FIG. 1 may be dispensed with. However, there are many instances when an overrunning load control is desired for both directions of operations of the hydraulic motor in which case the flow circuit illustrated is provided. Typical examples of the same are in, for example, the dump circuit of a dump truck. When the truck bed is being elevated, at some point in time the load will begin to shift about the pivot point of the bed and may cause the bed to snap upwardly about its pivot point. This represents an overrunning load condition during a load elevating procedure.

At the same time, overrunning load conditions may occur, for example, in the swing circuit of an excavator or the like due to inertia conditions or, more likely, to the fact that the excavator is not operating on a perfectly level surface with the consequence that the boom, when loaded, may tend to overrun in either direction.

The present invention provides excellent stability in the circuit. However, in cases where an even greater degree of stability is desired, a modified embodiment of the invention, seen in FIG. 2, may be employed. In the embodiment of FIG. 2, a modified valve 80', corresponding to the valve 80 is utilized. It is, in all respects, identical to the valve 80 except that fluid under pressure is not applied directly to the pilot surface 86. Rather, pilot pressure is directed against the surface 86 via a piston or slug 100 in abutment therewith. An additional piston 102, also in abutment with the surface 86, is provided and it may be pressurized via a line 104 connected to the outlet 90 of the valve 80'. The line 104 provides feedback, while the use of the pistons 100 and 102 provide isolation of the pilot circuit and the implement circuit from each other. Since the outlet 90 is connected to the reservoir 48, and consequently fluid thereat will be at a relatively low pressure insufficient to provide meaningful feedback, an orifice 106 is interposed between the outlet 90 and the reservoir 48 and downstream of the feedback line 104.

Should pressure at the inlet 88 of the valve 80' begin to vary, those skilled in the art will recognize that flow forces within the valve 80' itself will also vary. Consequently, an unwanted shift in the position of the spool 82 may occur as internal flow forces are changed even though external forces are the same. Of course, when the pressure at the inlet 88 begins to vary, due to the presence of the orifice 106, the pressure at the outlet 90 will also begin to vary. The feedback line 104 directs a balancing force via the piston 102 to the spool 82 to prevent the same from oscillating, i.e., acting unstably.

From the foregoing, it will be appreciated that a hydraulic system including an overrunning load control made according to the invention provides positive, fine and reproducible control of a hydraulic motor. It will also be appreciated that control characteristics are the same, independently of the load and that small variations in control due to instability of system components are eliminated.

The embodiments of the invention in which an exclusive property or privilege is claimed are defined as follows:

1. In a hydraulic system, the combination of:

a hydraulic motor having a port adapted to be connected to a reservoir, said motor being adapted for connection to a work performing means;

a hydraulic fluid reservoir;

means, including a check valve for connecting said port to said reservoir, said check valve normally preventing fluid flow from said port to said reservoir and including two hydraulically opposed, differential surfaces, one of said surfaces being smaller than the other of said surfaces and being disposed to be responsive to pressure at said port;

a pilot operated, first metering valve having an inlet and an outlet;

means for normally closing said first metering valve;

a second metering valve having an inlet, an outlet, a shiftable metering element interposed therebetween, means biasing said element towards a position minimizing flow between the inlet and the outlet, and a pressure responsive surface on said element in bucking relation to said biasing means;

said first valve inlet being connected to said second valve outlet and to said check valve other surface;

means connecting said port to said second valve inlet;

means for directing pressure at said port to said second valve surface; and means connecting said first valve outlet to said reservoir.

2. The hydraulic system of claim 1 further including a relief valve connected to said reservoir and in fluid communication with said check valve other surface between said other surface and said second valve.

3. The hydraulic system of claim 1 wherein said check valve is a poppet valve having a poppet, said surfaces being on opposite ends of said poppet.

4. The hydraulic system of claim 1 wherein said first valve includes a pressure responsive pilot surface having a piston abutting said pilot surface and further including a second piston abutting said pilot surface; an orifice interposed between said first valve outlet and said reservoir and means connecting said first valve outlet to said second piston.

5. In a hydraulic system, the combination of:

a hydraulic motor having a port;

conduit means adapted to be connected to a hydraulic fluid reservoir;

a main flow valve having an inlet connected to said port and an outlet connected to said conduit means;

pressure responsive actuator means for opening and closing said main flow valve;

control means for said pressure responsive actuator means housing a pressure responsive, variable orifice means and a continuously open fluid flow path of variable size connecting said port to said pressure responsive actuating means responsive to pressure connected to said port; and a variable flow metering valve interconnected between the junction of said orifice means flow path and said pressure responsive actuator means for controlling communication with said conduit means.

6. The hydraulic system of claim 5 wherein said metering valve is closeable; and said pressure responsive actuator means includes pressure responsive surfaces on a movable valve member forming part of said main flow valve.

7. The hydraulic system of claim 5 further including pressure feedback means for stabilizing said metering valve.

8. In a hydraulic system, the combination of:

a hydraulic motor having a port adapted to be connected to a reservoir, said motor being adapted for connection to a work performing means;

a hydraulic fluid reservoir;

means, including a check valve, for connecting said port to said reservoir, said check valve normally preventing fluid flow from said port to said reservoir and including two hydraulically opposed, differential surfaces, one of said surfaces being smaller than the other of said surfaces and being disposed to be responsive to pressure at said port;

a pilot operated, first metering valve having an inlet and an outlet;

means for normally closing said first metering valve;

a second metering valve having an inlet, an outlet, a shiftable metering element interposed therebetween, means biasing said element towards a position minimizing flow between the inlet and the outlet, and a pressure responsive surface on said element in bucking relation to said biasing means;

said first valve inlet being connected to said second valve outlet and to said check valve other surface;

means connecting said port to said second valve inlet;

means for directing pressure at said port to said second valve surface;

means, including an orifice, connecting said first valve outlet to said reservoir; and means for feeding back pressure at said first valve outlet to said first valve in bucking relation to said normally closing means.

9. In a hydraulic system, the combination of:

a hydraulic motor having a port adapted to be connected to a reservoir, said motor being adapted for connection to a work performing means;

a hydraulic fluid reservoir;

means, including a check valve, for connecting said port to said reservoir, said check valve normally preventing fluid flow from said port to said reservoir and including two hydraulically opposed, differential surfaces, one of said surfaces being smaller than the other of said surfaces and being disposed to be responsive to pressure at said port;

a settable metering valve having an inlet and an outlet;

pressure responsive valve means having an inlet and an outlet connected by a flow path, and orifice means for increasing the size of said flow path from a predetermined minimum;

said first valve inlet being connected to said second valve means outlet and to said check valve other surface;

said second valve means inlet and the pressure responsive portion of said second valve means being connected to said port; and means connecting said first valve outlet to said reservoir.

10. The hydraulic system of claim 9 further including pressure feedback means connected to said first valve outlet for bucking flow forces operating to change the setting of said first valve.

* * * * *